US010095150B2

(12) United States Patent
Hiramatsu et al.

(10) Patent No.: US 10,095,150 B2
(45) Date of Patent: Oct. 9, 2018

(54) IMAGE FORMING APPARATUS

(71) Applicant: CANON KABUSHIKI KAISHA, Tokyo (JP)

(72) Inventors: Takashi Hiramatsu, Tokyo (JP); Yusuke Usui, Tokyo (JP); Kuniaki Tamagaki, Kawasaki (JP); Hiroyoshi Iwayama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/849,789

(22) Filed: Sep. 10, 2015

(65) Prior Publication Data

US 2016/0097986 A1 Apr. 7, 2016

(30) Foreign Application Priority Data

Oct. 1, 2014 (JP) ..... 2014-203505

(51) Int. Cl.
*G03G 15/02* (2006.01)
*G03G 21/00* (2006.01)

(52) U.S. Cl.
CPC ..... *G03G 15/0258* (2013.01); *G03G 21/0064* (2013.01)

(58) Field of Classification Search
CPC ..... G03G 15/0258; G03G 15/0225; G03G 21/0064

(Continued)

(56) References Cited

U.S. PATENT DOCUMENTS 5,321,471 A * 6/1994 Ito ..... G03G 15/0216 399/129
5,541,717 A * 7/1996 Saito ..... G03G 15/0225 399/150

(Continued)

FOREIGN PATENT DOCUMENTS

CN 1164678 A 11/1997
JP S59-133573 A 7/1984

(Continued)

OTHER PUBLICATIONS

Office Action dated Sep. 5, 2017, in Chinese Patent Application No. 201510639218.6.

(Continued)

*Primary Examiner* — David M Gray
*Assistant Examiner* — Andrew V Do
(74) *Attorney, Agent, or Firm* — Fitzpatrick, Cella, Harper & Scinto

(57) ABSTRACT

An image forming apparatus includes an image bearing member, a charging member, a charging voltage source, an electrostatic image forming portion, a developing device, a developing voltage source, a transfer portion, a transfer voltage source, and a controller. During image formation, the toner remaining on the image bearing member after transfer is collected into the developing device while forming an image. In a cleaning operation performed during non-image formation, while rotating the image bearing member, the controller transfers the toner from the charging member onto the image bearing member, passes the toner through the developing portion in an urged state, reverses a charge polarity of the toner to a normal polarity at a charging portion, and then transfers the toner reversed in charge polarity from the image bearing member onto the develop- (Continued)

ing member at the developing portion to collect the toner in the developing device.

11 Claims, 3 Drawing Sheets

(58) Field of Classification Search
USPC ..... 399/100
See application file for complete search history.

(56) References Cited

U.S. PATENT DOCUMENTS

| | | | | | |
|---|---|---|---|---|---|
| 5,758,229 | A | * | 5/1998 | Kyung | G03G 15/0216 399/100 |
| 5,839,026 | A | * | 11/1998 | Ko | G03G 15/0225 399/100 |
| 6,006,055 | A | * | 12/1999 | Furuya | G03G 21/0064 399/148 |

FOREIGN PATENT DOCUMENTS

| | | | | |
|---|---|---|---|---|
| JP | H05-210300 | | | 8/1993 |
| JP | H06-35301 | A | | 2/1994 |
| JP | 07092781 | A | * | 4/1995 |
| JP | H08-137261 | A | | 5/1996 |
| JP | H10-003196 | A | | 1/1998 |
| JP | H11-072995 | A | | 3/1999 |
| JP | 3030188 | B2 | | 4/2000 |
| JP | 2003-302816 | A | | 10/2003 |
| JP | 2007-322634 | A | | 12/2007 |
| JP | 2009-151119 | A | | 7/2009 |

OTHER PUBLICATIONS

Office Action dated May 29, 2018, in Japanese Patent Application No. 2014-203505.

* cited by examiner

IMAGE FORMING APPARATUS

FIELD OF THE INVENTION AND RELATED ART

The present invention relates to an image forming apparatus, such as a copying machine, a printer or a facsimile machine, of an electrophotographic type or an electrostatic recording type.

In a conventional image forming apparatus of the electrophotographic type or the like, an image bearing member is electrically charged uniformly, and an electrostatic latent image is formed on the charged image bearing member and is developed with a toner, and thereafter a resultant toner image is transferred from said image bearing member onto a toner image receiving member. Then, a residual toner remaining on the image bearing member after the transfer of the toner image is removed from the image bearing member and is collected.

As a means for removing and collecting the residual toner, a cleaning device including a cleaning member such as a cleaning blade has been widely used. The toner collected by the cleaning device is a waste toner, but it is desirable that the waste toner does not generate from the viewpoints of environmental protection, effective use of resources, and the like. Further, from the viewpoint of downsizing of the image forming apparatus or the like, it is desirable that the cleaning device is not provided.

Therefore, there is a cleanerless system in which the residual toner is removed and collected from the image bearing member by "simultaneous development and cleaning" in a developing device and then is reused (Japanese Laid-Open Patent Application (JP-A) Sho 59-133573).

On the other hand, as a means for electrically charging the image bearing member, in recent years, a contact charging type in which a charging member is contacted to the image bearing member and then the image bearing member is electrically charged by applying a voltage to the charging member has been employed and advanced. Compared with a corona charging type, the contact charging type generates ozone in a small amount by a charging process and is low in necessary voltage, and therefore is preferred from the viewpoints of environment and downsizing of the image forming apparatus, so that the contact charging type has been used widely.

In the image forming apparatus employing the cleanerless system and the contact charging type, in some cases, a part of the toner charged to an opposite polarity to a charge polarity (also referred to as a "normal polarity") of the toner during the development deposits on the charging member and accumulates on the charging member, and thus charging power deteriorates.

Therefore, Japanese Patent No. 3030188 proposes that the toner charged to the opposite polarity to the normal polarity and deposited on the charging member is electrostatically deposited on the image bearing member, and then the charge polarity of the toner is reversed to the normal polarity by sliding the toner with a developing roller of the developing device to collect the toner in the developing device.

However the charging polarity of the toner charged to the opposite polarity to the normal polarity cannot be sufficiently reversed by sliding the toner with the developing roller depending on an operation environment of the image forming apparatus and setting of the developing device in some cases.

For that reason, in the image forming apparatus employing the cleanerless system and the contact charging type, a new method is required for collecting the toner in the developing device that deposits on the charging member and that is charged to the opposite polarity to the normal polarity.

SUMMARY OF THE INVENTION

A principal object of the present invention is to provide an image forming apparatus capable of sufficiently electrically charging the toner, charged to an opposite polarity to a normal polarity of the toner deposited on a charging member, to the normal polarity and then capable of collecting the charged toner.

According to an aspect of the present invention, there is provided an image forming apparatus comprising: a rotatable image bearing member; a charging member for electrically charging the image bearing member in contact with the image bearing member at a charging portion by being supplied with a voltage; a charging voltage source for applying the voltage to the charging member; electrostatic image forming means for forming an electrostatic image on the image bearing member electrically charged; a developing device including a developing member for forming a toner image by being supplied with a voltage to supply a toner charged to a normal polarity to the electrostatic image on the image bearing member at a developing portion; a developing voltage source for applying the developing member; transfer means for electrostatically transferring the toner image from the image bearing member onto a toner image receiving member at a transfer portion by being supplied with a voltage; a transfer voltage source for applying the voltage to the transfer means; and a controller for executing a cleaning operation for decreasing an amount of the toner deposited on the charging member during non-image formation, wherein during image formation, the toner remaining on the image bearing member after transfer is collected into the developing device by the developing member while forming an image by transferring the toner image onto the toner image receiving member, and wherein in the cleaning operation, while rotating said image bearing member, the controller electrostatically transfers the toner deposited on said charging member and charged to an opposite polarity to the normal polarity from the charging member onto the image bearing member, passes the transferred toner through the developing portion in a state that the transferred toner is electrostatically urged from the developing member toward the image bearing member, reverses a charge polarity of the passed toner to the normal polarity at the charging portion, and then electrostatically transfers the toner reversed in charge polarity from the image bearing member onto the developing member at the developing portion to collect the toner in the developing device.

These and other objects, features and advantages of the present invention will become more apparent upon a consideration of the following description of the preferred embodiments of the present invention taken in conjunction with the accompanying drawings.

DESCRIPTION OF THE EMBODIMENTS

An image forming apparatus according to the present invention will be described in detail with reference to Embodiment 1.

Embodiment 1

1. General Structure and Operation of Image Forming Apparatus

Figure 1:
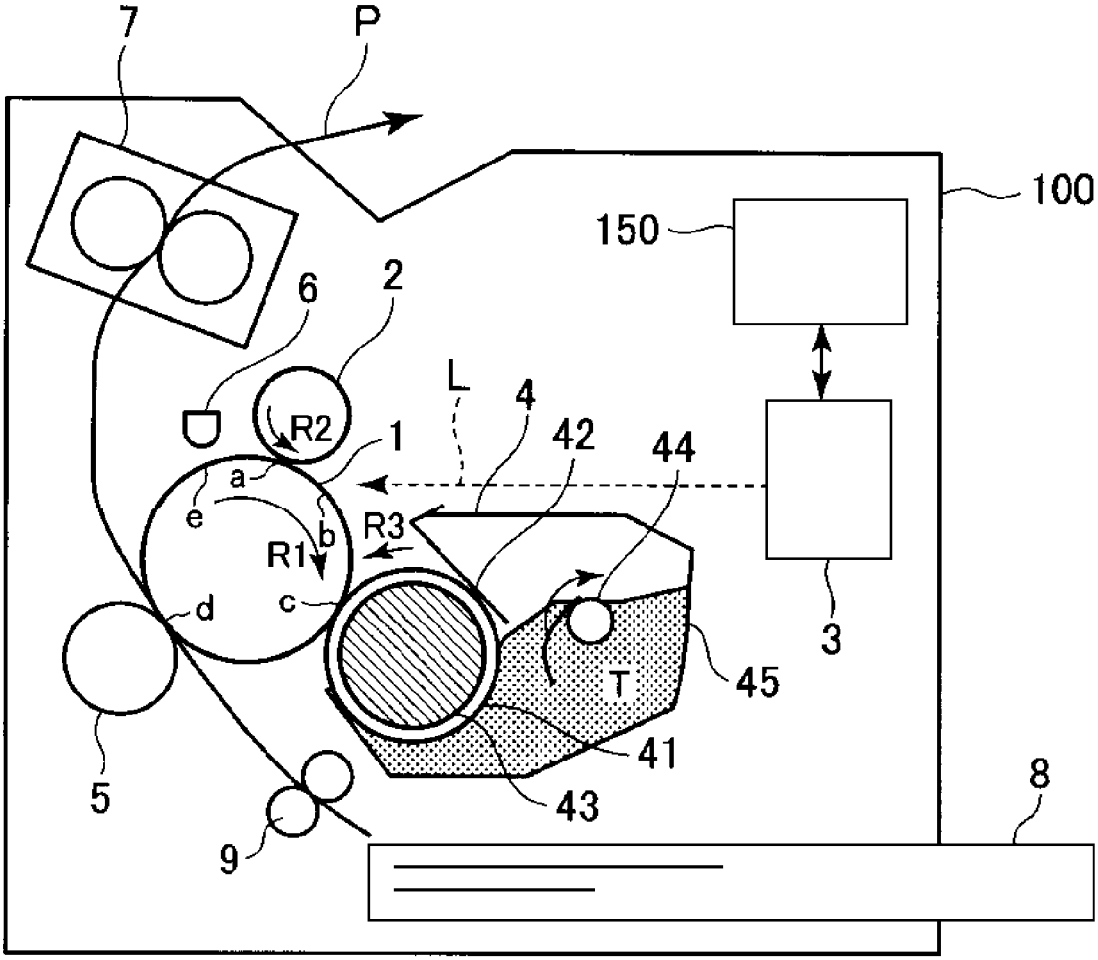
FIG. 1 is a schematic sectional view of an image forming apparatus.

FIG. 1 is a schematic sectional view of an image forming apparatus 100 according to Embodiment 1 of the present invention. The image forming apparatus 100 in this embodiment is a laser beam printer of an electrophotographic type employing a cleanerless system and a contact charging type.

The image forming apparatus 100 includes a photosensitive drum 1 which is a drum-shaped (cylindrical) electrophotographic photosensitive member as a rotatable image bearing member. When an image outputting is started, the photosensitive drum 1 is rotationally driven by a driving motor (not shown) in an arrow R1 direction indicated in FIG. 1.

A surface of the rotating photosensitive drum 1 is electrically charged uniformly to a predetermined polarity (negative (polarity) in this embodiment) and a predetermined potential by a charging roller which is a roller-shaped charging member as a charging means. The charging roller 2 is provided in contact with the photosensitive drum 1 and is rotationally driven by a driving motor (not shown) in an arrow R2 direction indicated in FIG. 1. At this time, to the charging roller 2, a predetermined charging voltage (charging bias) which is a negative DC voltage is applied from a charging voltage source E1 (FIG. 2) as a charging voltage applying means. A contact portion between the photosensitive drum 1 and the charging roller 2 is a charging nip a. Further, with respect to a rotational direction of the photosensitive drum 1, a position where the photosensitive drum 1 is charged by the charging roller 2 is a charging portion. The charging roller 2 charges the surface of the photosensitive drum 1 by electric discharge generating in at least one of gaps formed between the charging roller 2 and the photosensitive drum 1 in an upstream side and a downstream side of the charging nip a with respect to the rotational direction of the photosensitive drum 1. In this embodiment, for convenience of easy understanding, the charging process of the surface of the photosensitive drum 1 is deemed to be performed at the charging nip, and the charging nip is described as the charging portion a in some cases.

The surface of the charged photosensitive drum 1 is subjected to scanning exposure to a laser beam L modulated depending on image data by an exposure device (laser exposure unit) 3 as an exposure means (electrostatic image forming means). The exposure device 3 forms an electrostatic latent image (electrostatic image) on the photosensitive drum 1 by subjecting the photosensitive drum surface to exposure to the laser beam 1 also with respect to a sub-scanning direction (surface movement direction) while repeating the exposure with respect to a main scanning direction (rotational axis direction) of the photosensitive drum 1. With respect to the rotational direction of the photosensitive drum 1, an exposure position of the photosensitive drum 1 by the exposure device 3 is an image exposure portion b.

The electrostatic latent image formed on the photosensitive drum 1 is developed (visualized) as a toner image with toner as a developer by a developing device 4 as a developing means. The developing device 4 includes a developing container 45 and a developing sleeve 41 as a developing member (developer carrying member) rotatably supported by the developing container 45. A toner T of black which is a magnetic one-component developer as the developer is accommodated. The toner T in this embodiment is negatively chargeable. That is, in this embodiment, a normal polarity (charging polarity during development) of the toner T is negative. The developing sleeve 41 is disposed at an opening provided at an opposing position of the developing container 45 to the photosensitive drum 1 so as to be partly exposed to an outside of the developing container 45. The developing sleeve 41 is prepared by providing an electroconductive elastic rubber layer having a predetermined volume resistivity at a periphery of a hollow non-magnetic metal (such as aluminum) bare tube. At a hollow portion of the developing sleeve 41, a magnet roller 43 as a magnetic field generating means is fixedly provided.

The toner T accommodated in the developing container 45 is not only stirred by a stirring member 44 but also supplied to the surface of the developing sleeve 41 by a magnetic force of the magnet roller 43. The toner supplied to the surface of the developing sleeve 41 passes through an opposing portion to the developing blade 42 as a developer regulating member with rotation of the developing sleeve 41, so that the toner T is formed uniformly in a thin layer and is negatively charged triboelectrically. Thereafter, the toner on the developing sleeve 41 is fed to the developing position, where the developing sleeve 41 contacts the photosensitive drum 1, with the rotation of the developing sleeve 41, and is transferred onto the photosensitive drum 1 depending on the electrostatic latent image on the photosensitive drum 1, so that the electrostatic latent image on the photosensitive drum 1 is developed with the toner. At this time, to the developing sleeve 41, a predetermined developing voltage (developing bias) which is a negative DC voltage is applied from a developing voltage source E2 (FIG. 2) as a developing voltage applying means. In this embodiment, the toner image is formed by image portion exposure and reverse development. That is, the photosensitive drum surface is exposed to light after being uniformly charged, whereby the toner charged to the same polarity (negative in this embodiment) as the charge polarity of the photosensitive drum 1 is deposited on an exposed portion (image portion) on the photosensitive drum 1 decreased in absolute value of the potential. With respect to the rotational direction, a position where the photosensitive drum 1 opposes (contacts) the developing sleeve 41 is a developing portion c.

In this embodiment, the developing sleeve 41 is rotationally driven in an arrow R3 direction (FIG. 3) by a driving motor (not shown) so that movement directions of the photosensitive drum 1 and the developing sleeve 41 are the same direction at the developing portion c. In this embodiment, the photosensitive drum 1 and the developing sleeve 41 are rotationally driven so as to move at the developing portion c with a predetermined peripheral speed difference between the photosensitive drum 1 and the developing sleeve 41. In this embodiment, a peripheral speed of the developing sleeve 41 is made faster than a peripheral speed of the photosensitive drum 1.

The toner image formed on the photosensitive drum 1 is sent to a transfer portion d which is a contact portion between the photosensitive drum 1 and a transfer roller 5 which is a roller-type transfer member as a transfer means. In synchronization with the timing of the toner image on the photosensitive drum 1, a recording material P such as a recording sheet, which is a toner image receiving member, is sent from an accommodating portion 8 to the transfer portion d by a feeding roller 9 and the like. Then, the toner image on the photosensitive drum 1 is transferred at the transfer portion d by the action of the transfer roller 5 onto the recording material P sandwiched and between the photosensitive drum 1 and the transfer roller 5. At this time, a predetermined transfer voltage (transfer bias), which is a DC voltage of the opposite polarity (positive in this embodiment), is applied to the transfer roller 5 from a transfer voltage source E3 (FIG. 2), which is a transfer voltage applying means. As a result, the toner image is electrostatically transferred from the photosensitive drum 1 onto the recording material P by the action of an electric field formed between the transfer roller 5 and the recording material P.

The recording material P on which the toner image is transferred is sent to a fixing device 7 as a fixing means. In the fixing device 7, heat and pressure are applied to the recording material P, so that the toner image transferred on the recording material P is fixed on the recording material P.

On the other hand, a transfer residual toner (remaining toner) remaining on the photosensitive drum 1 without being transferred onto the recording material P is collected in the developing device 4 by simultaneous development and cleaning. That is, the developing device 4 includes a developing member 41 for forming the toner image by being supplied with a voltage to supply the toner charged to the normal polarity to the electrostatic latent image on the image bearing member at the developing portion c. The developing device 4 collects the toner remaining on the image bearing member after the toner image transfer by the developing member 41 simultaneously with formation of the toner image. Details of the simultaneous development and cleaning will be described hereinafter.

An image outputting operation is executed by repeating the steps described above.

Here, the image forming apparatus 100 performs a series of image outputting operation (job) steps which are started by a single start instruction and in which a single or a plurality of recording materials P are subjected to image formation and is discharged (outputted) from an apparatus main assembly of the image forming apparatus 100. The job includes an image forming step (printing step), a pre-rotation step, a sheet interval (recording material interval) step in the case where the image is formed on the plurality of recording materials P, and a post-rotation step is general. The image forming step is performed in a period in which formation of the electrostatic latent image on the photosensitive drum 1, development of the electrostatic latent image, transfer of the toner image, fixing of the toner image and the like are carried out in actuality. Specifically, timing of the image forming step varies depending on positions where the respective steps of charging, exposure, development, transfer, fixing and the like are performed. The pre-rotation step is performed in a period in which a preparatory operation is carried out before the image forming step. The sheet interval step is performed in a period corresponding to an interval between a recording material P and a subsequent recording material P at the transfer portion d when a plurality of image forming steps are continuously performed with respect to a plurality of recording materials P. The post-rotation step is performed in a period in which a post-operation (preparatory operation) after the image forming step is carried out. The image forming step is performed during image formation, and in periods, other than during the image formation, such as those of the pre-rotation step, the sheet interval step, the post-rotation step and the like correspond to during non-image formation. In this embodiment, at predetermined timing during the non-image formation, a cleaning operation for decreasing an amount of the toner deposited on the charging roller 2 is carried out.

2. Simultaneous Development and Cleaning

In this embodiment, the transfer residual toner (remaining toner) remaining on the photosensitive drum 1 without being transferred on the recording material P is removed from the photosensitive drum 1 by the simultaneous development and cleaning and is collected in the developing device 4, and then is reused.

Here, the transfer residual toner enters the charging portion a before reaching the developing portion c. In this embodiment, in order to pass the transfer residual toner through the charging portion a without causing deposition of the transfer residual toner on the charging roller 2 to the possible extent, the following two constitutions are employed.

A first constitution is such that a pre-exposure device (pre-exposure lamp) 6 is provided as a charge-removing means for charge-removing the photosensitive drum 1 in a side downstream of the transfer portion d and upstream of the charging portion a with respect to the rotational direction of the photosensitive drum 1. The pre-exposure device 6 photo-removes the surface potential of the photosensitive drum 1 before the photosensitive drum 1 enters the charging portion a in order to generate stable electric discharge at the charging portion a. An exposure position by the pre-exposure device 6 is a charge-removing portion e with respect to the rotational direction of the photosensitive drum 1. The transfer residual toner principally includes a toner charged to a positive charge polarity which is the opposite polarity to the normal polarity, a toner which is negatively charged but which does not have a sufficient electric charge, and the like toner. The photosensitive drum 1 is charge-removed by the pre-exposure device 6, whereby it becomes possible to uniformly generate the electric discharge during the charging process, and at the same time, it becomes possible to electrically charge the transfer residual toner to the negative polarity uniformly.

A second constitution is such that the charging roller 2 is rotationally driven with a predetermined peripheral speed difference from the photosensitive drum 1. Although most of the toner is charged to the negative polarity by the electric discharge as described above, the toner which cannot be sufficiently charged negatively somewhat remains and deposits on the charging roller 2 in some cases. By driving and rotating the charging roller 2 and the photosensitive drum 1 with the predetermined peripheral speed difference, the toner depositing on the charging roller 2 can be sufficiently charged to the negative polarity by sliding (friction) between the photosensitive drum 1 and the charging roller 2. As a result, an effect of suppressing the deposition of the toner on the charging roller 2 is obtained. In this embodiment, the charging roller 2 is rotationally driven at the peripheral speed higher than the peripheral speed of the photosensitive drum 1 so that the charging roller 2 moves in the same direction as the movement direction of the photosensitive drum 1 at the contact portion with the photosensitive drum 1.

As described above, the toner charged to the negative polarity at the charging portion a is thereafter sent to the developing portion c with the rotation of the photosensitive drum 1. Then, at a non-image portion (non-exposure portion), by a potential difference between a dark portion potential (Vd) of the surface of the photosensitive drum 1 and a developing bias (Vdc), the negative charged toner is transferred onto the developing sleeve 41 and then is collected in the developing device 4. On the other hand, at the image portion exposed portion, by a potential difference between a light portion potential (Vl) of the surface of the photosensitive drum 1 and the developing bias (Vdc), the negatively charged toner is not transferred onto the developing sleeve 41. However, this portion is the image portion, and therefore the toner can remain on the photosensitive drum 1 as it is, and thereafter is transferred onto the recording material P. Incidentally, Vdc is set at a potential between Vd and Vl.

3. Control Manner

Figure 2:
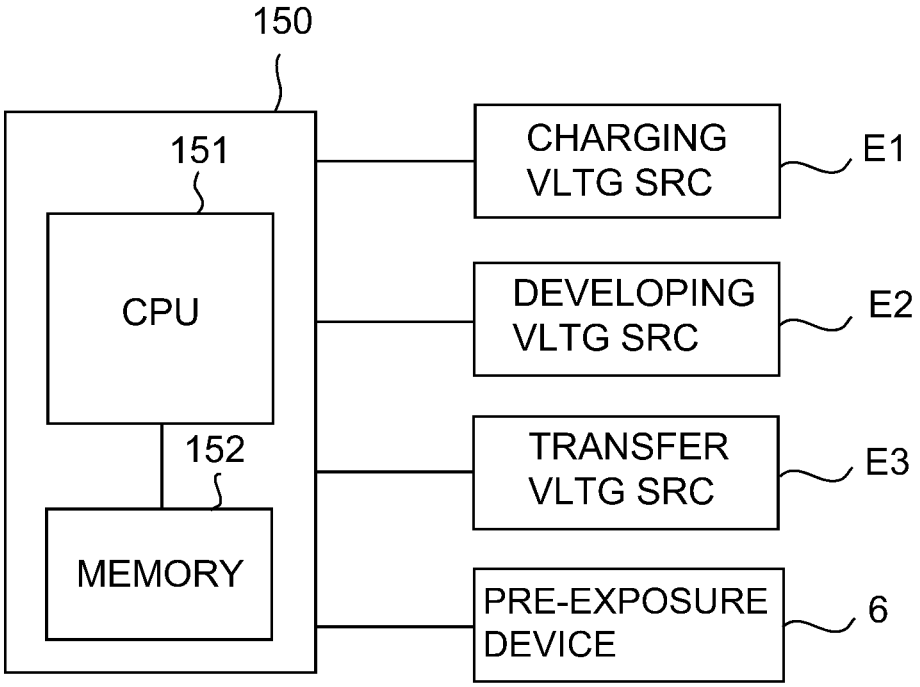
FIG. 2 is a block diagram showing a schematic control manner of a principal part of the image forming apparatus.

FIG. 2 is a block diagram showing a schematic control manner (mode) of a principal part of the image forming apparatus 100 in this embodiment. A controller 150 as a control means provided in the image forming apparatus 100 is constituted by including CPU 151 which is a central element (device) for performing computation and including a memory 152, such as ROM or RAM, as a storing element (device). In the RAM, a detection result of a sensor, a computation result, and the like are stored, and in the RAM, a control program, a data table obtained in advance, and the like are stored. The controller 150 is the control means for effecting integrated control of the operation of the image forming apparatus 100, and controls transfer of various electrical information signals, driving timing and the like, and thus effects predetermined image forming sequence control and the like. With the controller 150, respective objects to be controlled are connected. For example, the charging voltage source E1, the developing voltage source E2, the transfer voltage source E3, the pre-exposure device 6 and the like are connected with the controller 150. Particularly, in this embodiment, the controller 150 executes the cleaning operation of the charging roller 2 described later by controlling ON/OFF and output values of the various voltage sources E1, E2 and E3 and ON/OFF of irradiation with charge-removing light, and the like.

4. Cleaning Operation of Charging Roller (Feature of Cleaning Operation of Charging Roller in this Embodiment)

As described above, the transfer residual toner is negatively charged at the charging portion a and passes through the charging portion a, and then is sent to the developing portion c. However, as a part of the transfer residual toner, there is a toner which continuously deposits on the charging roller 2 without being sufficiently charged to the negative polarity at the charging portion a. When the image formation is continued in a state in which this toner deposits on the charging roller 2, due to adhesion of the toner to the charging roller 2, a lowering in charging performance or the like generates in some cases.

For that reason, it is desired that the toner depositing on the charging roller 2 is deposited on the photosensitive drum 1 and is sent to the developing portion c, and then is returned into the developing device 4 at predetermined timing. However, when the toner deposits on the charging roller 2, a positive polarity component of the toner depositing on the charging roller 2 increases due to an electric discharge phenomenon when the photosensitive drum 1 is charged by the electric discharge from the charging roller 2. For that reason, even when the charge polarity of the toner is intended to be reversed to the negative polarity by friction, the positively charged toner cannot be sufficiently reversed in polarity to the negative polarity in some cases.

Thereafter, in this embodiment, the controller 150 carries out the following cleaning operation for decreasing the amount of the toner depositing on the charging roller 2 at predetermined timing during the non-image formation. In the cleaning operation, the controller 150 electrostatically transfers the toner, deposited on the charging roller 2 and charged to the opposite polarity to the normal polarity from the charging roller 2 onto the photosensitive drum 1. Then, the controller 150 passes the transferred toner through the developing portion c in a state in which the toner is urged from the developing sleeve 41 toward the photosensitive drum 1. Then, the controller 150 reverses the charge polarity of the passed toner to the normal polarity at the charging portion a. Then, the controller 150 electrostatically transfers at the developing portion c the charge polarity-reversed toner from the photosensitive drum 1 onto the developing sleeve 41, and then collects the toner in the developing device 4. This will be described specifically in the following paragraphs.

In this embodiment, the toner, positively charged and deposited on the charging roller 2, is deposited electrostatically (in an electric field manner) on the photosensitive drum 1 while being positively charged. That is, the voltage applied to the charging roller 2 is changed to a voltage in the positive polarity side relative to the surface potential of the photosensitive drum 1, so that the toner is electrostatically transferred from the charging roller 2 onto the photosensitive drum 1 while being charged to the positive polarity. Then, the positively charged toner deposited on the photosensitive drum 1 is passed through the developing portion c by the charge polarity without being collected in the developing device 4 at the developing portion c. Thereafter, not only a region of the photosensitive drum 1 on which the positively charged toner is deposited is electrically charged by the electric discharge from the charging roller 2, but also the charge polarity of the positively charged toner is reversed to the negative polarity. At this time, in this embodiment, the region of the photosensitive drum 1 on which the positively charged toner is deposited is charged by the charging roller 2 after being subjected to the photo-charge removal by the pre-exposure device 6. Then, the negatively charged toner is, after passing through the charging portion a, electrostatically transferred onto the developing sleeve 41 at the developing portion c, where the toner is collected in the developing device 4.

Figure 3:
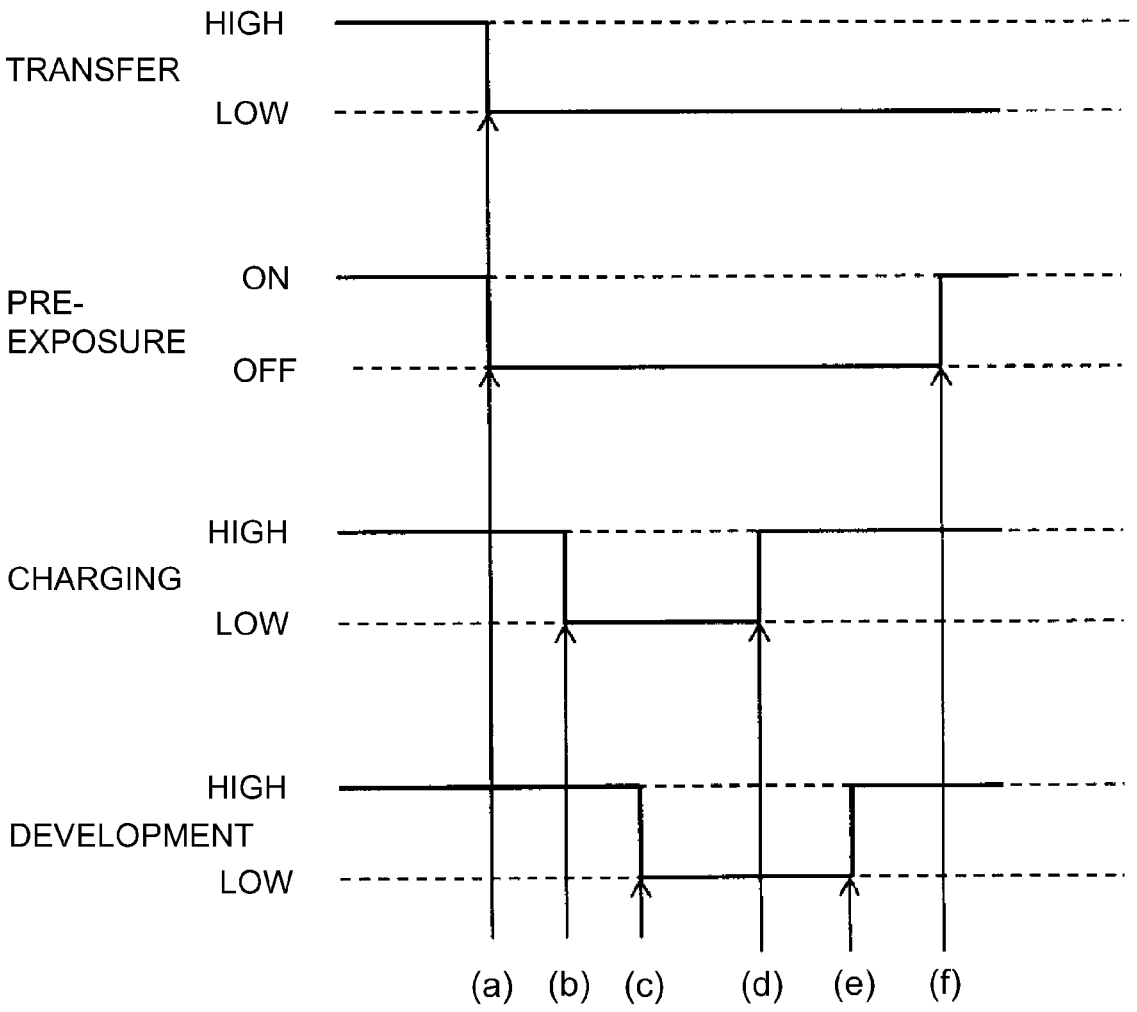
FIG. 3 is a timing chart of a cleaning operation of a charging roller.

FIG. 3 is a timing chart of the cleaning operation of the charging roller 2 in this embodiment. The cleaning operation of the charging roller 2 is executed by controlling the operations of the respective portions by the controller 150 at timing shown in FIG. 3. In this embodiment, in the case where the number of sheets subjected to image output is not less than a threshold, in post-rotation, the cleaning operation of the charging roller 2 is carried out.

Timing (a):

When the printing step is ended, the transfer bias is changed from "HIGH" to "LOW". By changing the transfer bias to "LOW", flow of electric charges from the transfer roller 5 is prevented, so that a lowering in surface potential of the photosensitive drum 1 after the photosensitive drum 1 passes through the transfer portion d is suppressed. At the same time, the pre-exposure device 6 is turned "OFF", so that a lowering in surface potential of the photosensitive drum 1 by the photo-charge removed before the photosensitive drum region reaches the charging portion a is eliminated. In this way, the transfer bias is changed to "LOW" and the pre-exposure device 6 is turned "OFF", whereby the photosensitive drum 1 maintains the charge potential. Also after the printing step is ended, the charging bias and the developing bias are kept "HIGH". That is, not only the photosensitive drum 1 is charged by applying the predetermined charging voltage to the charging roller 2 but also the predetermined developing voltage is applied to the developing sleeve 41 when the region of the charged photosensitive drum 1 passes through the developing portion c (step (a)). When the region of the photosensitive drum 1 which should pass through the charging portion a when a voltage after changed in a step (b) described later is applied to the charging roller 2 passes through the transfer portion d, to the transfer roller 5, a voltage higher in the normal polarity side than the voltage applied to the transfer roller 5 during the image formation is applied. When the region of the photosensitive drum 1 which should pass through the charging portion a when the voltage after changed in the step (b) described later is applied to the charging roller 2 passes through the charge-remaining portion e, the charge-removing process of the photosensitive drum 1 by the pre-exposure device 6 is not performed.

Timing (b):

When the region of the photosensitive drum 1 passed through not only the transfer portion d in a state of "LOW" of the transfer bias but also the charge-removing portion e in a state of "OFF" of the pre-exposure device 6 reaches the charging portion a, the charging bias is changed from "HIGH" to "LOW". As a result, the charging bias is changed to a voltage (e.g., a voltage having the same polarity as the surface potential of the photosensitive drum 1 but having an absolute value smaller than the surface potential of the photosensitive drum 1) higher in the positive polarity side than the surface potential of the photosensitive drum 1. In this embodiment, the "LOW" charging bias applied to the charging roller 2 at this time is set so that a potential difference between the photosensitive drum 1 and the charging roller 2 at the charging portion a is not less than an electric developing sleeve start voltage Vth. For that reason, the absolute value of the surface potential of the photosensitive drum 1 becomes small by generation of reverse electric discharge from the photosensitive drum 1 to the charging roller 2. That is, the absolute value of the surface potential of the photosensitive drum 1 is smaller than that immediately before the photosensitive drum region reaches the charging portion a by passing of the photosensitive drum region through the charging portion a. Then, the positively charged toner depositing on the charging roller 2 electrostatically deposits on the photosensitive drum 1 while being charged to the positive polarity. Further, the toner which has no polarity and which deposits on the charging roller 2 in a small amount is negatively charged by the reverse electric discharge described above. That is, when the region of the photosensitive drum 1 charged in the step (a) passes through the charging portion a, the voltage applied to the charging roller 2 is changed to a voltage higher in opposite polarity side to the normal polarity than the surface position of the photosensitive drum region when the region reaches the charging portion a (step (b)).

Timing (c):

When the region of the photosensitive drum 1 passed through the charging portion a in the state of "LOW" of the charging bias reaches the developing portion c, the developing bias is changed from "HIGH" to "LOW. That is, by the above-described reverse electric discharge, the absolute value of the surface potential of the photosensitive drum 1 becomes small. For that reason, correspondingly thereto, the developing bias is changed to "LOW" so as to be a voltage (e.g., a voltage having the same polarity as the surface potential of the photosensitive drum 1 but having an absolute value smaller than the surface potential of the photosensitive drum 1) higher in the positive polarity side than the surface potential of the photosensitive drum 1. By changing the developing bias to the "LOW" state, most of the positively charged toner on the photosensitive drum 1 passes through the developing portion c in an electrostatically urged state from the developing sleeve 41 toward the photosensitive drum 1. At this time, a part of the positively charged toner on the photosensitive drum 1 may be collected in the developing device 4. That is, the voltage applied to the developing sleeve is changed to the voltage higher in the opposite polarity side to the normal polarity than the above-described predetermined developing voltage when the region of the photosensitive drum passed through the charging portion a when the voltage after changed in the step (b) is applied to the charging roller passes through the developing portion c (step (c)).

Timing (d):

After the charging roller 2 is rotated through one full circumference or more in the "LOW" state of the charging roller 2, the charging bias is returned to "HIGH". By changing the charging bias to a voltage (having the same polarity and a larger absolute value) higher in the negative polarity side than the surface potential of the photosensitive drum 1, the negatively charged toner remaining on the charging roller 2 in a small amount under application of the "LOW" charging bias is electrostatically deposited on the photosensitive drum 1. Incidentally, a timing when the charging bias is returned from "LOW" to "HIGH" may preferably be after a rotation of the charging roller 2 through at least one full circumference in order to permit cleaning of the charging roller 2 through full circumference. Further, in order that the cleaning operation of the charging roller 2 is not prolonged more than necessary, the charging bias may preferably be returned from "LOW" to "HIGH" at a timing when the region of the photosensitive drum 1 passed through the charging portion a in the "LOW" state of the charging bias reaches the charging portion a after the rotation of the photosensitive drum 1 through one full circumference. However, the timing when the charging bias is returned from "LOW" to "HIGH" may also be after the rotation of the photosensitive drum through not less than one full circumference. Incidentally, the voltage at the "HIGH" charging bias is not limited to the voltage before the change of the charging bias to the "LOW" voltage, but may only be required to be a voltage higher in the normal polarity side of the toner than the "LOW" charging bias. That is, the voltage applied to the charging roller 2 is changed to the voltage higher in the normal polarity side than the voltage after changed in the step (b) when the region of the photosensitive drum 1 passed through the charging portion a when the voltage after the change in the step (b) is applied to the charging roller 2 passes through the charging portion a (step (d)).

Timing (e):

When the region of the photosensitive drum 1 passed through the charging portion a in a state in which the region of the photosensitive drum 1 passed through the charging portion a in the "LOW" state of the charging bias passes through the developing portion c and then the charging bias is returned to the "HIGH" state reaches the developing portion c, the developing bias is returned to "HIGH". The region of the photosensitive drum 1 passed through the charging portion a in the "LOW" state of the charging bias is a region in which the absolute value of the surface potential of the photosensitive drum 1 becomes small. Further, the region of the photosensitive drum 1 passed through the charging portion a in the "HIGH" state of the charging bias is a region in which the photosensitive drum 1 has the charge potential during normal image formation in this embodiment. The timing when the developing bias is returned from "LOW" to "HIGH" can be changed depending on the timing when the charging bias is returned from "LOW" to "HIGH". Further, the "HIGH" developing bias after changed as described above is not limited to the voltage before changed to the "LOW" developing bias, but may only be required to be a voltage higher in the normal polarity side of the toner than the "LOW" developing bias. That is, the voltage applied to the developing sleeve 41 is changed to the voltage higher in the opposite polarity side to the normal polarity than the voltage after changed in the step (c) when the region of the photosensitive drum 1 passed through the charging portion a when the voltage after changed in the step (d) is applied to the charging roller 2 passes through the developing portion c (step (e)).

Timing (f):

When the region of the photosensitive drum 1 passed through the charging portion a in the "LOW" state of the charging bias reaches the charge-removing portion e, the pre-exposure device 6 is turned "ON". That is, the region of the photosensitive drum 1 passed through the charging portion a in the "LOW" state of the charging bias is a region in which the positively charged toner is deposited on the photosensitive drum 1 from the charging roller 2, and before this region enters the charging portion a again, this region is subjected to photo-charge removal by the pre-exposure device 6. The absolute value of the surface potential of the photosensitive drum 1 entering the charging portion a after the pre-exposure device 6 is turned "ON" is made small, so that the electric discharge from the charging roller 2 to the photosensitive drum 1 is accelerated. As a result, the charge polarity of the positively charged toner depositing on the photosensitive drum 1 is sufficiently reversed to the negative polarity. The toner charged to the negative polarity which is the normal polarity of the toner passes through the charging portion a in an electrostatically urged state from the charging roller 2 to the photosensitive drum 1, and thereafter is electrostatically transferred onto the developing sleeve 41 at the developing portion c, so that the toner is collected in the developing device 4. That is, when the region of the photosensitive drum 1 which should pass through the charging portion a when the voltage after the change in the step (d) described later is applied to the charging roller 2 passes through the charge-remaining portion e, the charge-removing process of the photosensitive drum 1 by the pre-exposure device 6 is performed.

Specific Example

A specific example of the cleaning operation of the charging roller 2 in this embodiment will be described.

In this example, the photosensitive drum 1 is 24 mm in outer diameter, the charging roller 2 is 9 mm in outer diameter, and the photosensitive drum 1 is 160 mm/sec in peripheral speed (surface speed). Further, the charging roller 2 is rotationally driven at a speed which is 1.2 times the peripheral speed (surface speed) of the photosensitive drum 1, and therefore the charging roller 2 is 192 mm/sec in peripheral speed (surface speed). The respective biases during the image formation includes a transfer bias of +1000 V (HIGH), a charging bias of +1400 V (HIGH) and a developing bias of −500 V (HIGH). During the image formation, the surface of the photosensitive drum 1 is charged to a charge potential of −800 V (dark portion potential: Vd) by the charging bias. Further, the surface potential of the photosensitive drum 1 subjected to photo-charge removal by the pre-exposure device 6 becomes about −100 V equal to the surface potential (light portion potential: Vl) at the exposure portion by the exposure device 3.

After the printing step is ended, the transfer bias of about −1300 V (LOW) is applied to the transfer roller 5, and the pre-exposure device 6 is turned "OFF" (timing (a)). For that reason, the surface potential of the photosensitive drum 1 is about −800 V immediately in front of the charging portion a.

When the region of the photosensitive drum 1 having the surface potential of −800 V reaches the charging portion a, the charging bias is changed from −1400 V (HIGH) to 0 V (LOW) (timing (b)). When the charging bias is changed to 0 V, at the charging portion a, a potential difference between the surface potential of the photosensitive drum 1 and the potential of the charging roller 2 is not less than an electric discharge start voltage Vth. For that reason, reverse electric discharge from the photosensitive drum 1 to the charging roller 2 generates, so that the surface potential of the photosensitive drum 1 becomes about −600 V. In this embodiment, the electric discharge start voltage Vth (absolute value) between the photosensitive drum 1 and the charging roller 2 is about 600 V.

When the region of the photosensitive drum 1 in which the surface potential becomes −600 V reaches the developing portion c, the developing bias is changed from −500 V (HIGH) to 0 V (LOW) (timing (c)).

After a lapse of 300 msec which is a time from the change of the charging bias to 0 V (LOW) until the charging roller 2 rotates through not less than one full circumference, the charging bias is returned from 0 V (LOW) to −1400 V (HIGH) (timing (d)). When the charging bias is returned to −1400 V (HIGH), the surface potential of the photosensitive drum 1 after passed through the charging portion a becomes −800 V.

When the region of the photosensitive drum 1 having the surface potential of −800 V reaches the developing portion c, the developing bias is returned from 0 V (LOW) to −500 V (HIGH) (timing (e)).

When the region (in which the positively charged toner deposits) of −600 V in surface potential of the photosensitive drum 1 reaches the charge-removing portion e, the pre-exposure device 6 is turned "ON" (timing (f)). Then, the surface potential of the photosensitive drum 1 is lowered from −600 V before the region passes through the charge-removing portion e to −100 V after the region passes through the charge-removing portion e. As a result, an amount of the electric discharge from the charging roller 2 to the region in which the surface potential of the photosensitive drum 1 is lowered to −100 V is increased, so that the charge polarity of the positively charged toner reaching on the region is sufficiently reversed to the negative polarity which is the normal polarity. The toner of which charge polarity is reversed to the negative polarity passes through the charging portion a and thereafter is electrostatically transferred onto the developing sleeve 41, and then the toner is collected in the developing container 45 of the developing device 4.

As described above, according to this embodiment, in the cleaning operation of the charging roller 2, the toner which is deposited from the charging roller 2 onto the photosensitive drum 1 and which is charged to the opposite polarity to the normal polarity is sufficiently charged to the normal polarity, so that the toner is transferred onto the developing sleeve 41 and then can be collected in the developing device 4. According to this embodiment, by stable electric discharge at the charging portion a, the charge polarity of the toner charged to the opposite polarity to the normal polarity is reversed to the normal polarity, and therefore the reverse of the charge polarity can be sufficiently made irrespective of the operation condition such as an operation environment, setting of the developing device, or the like.

In this embodiment, the period in which the charging bias is in the "LOW" state was 300 msec which is the time of rotation of the charging roller 2 through not less than one full circumference (less than one full circumference of the photosensitive drum 1), but is not limited thereto. It is also possible to rotate the charging roller 2 through a plurality of full circumferences (not less than one full circumference of the photosensitive drum 1) while placing the charging bias in the "LOW" state. It is also possible to repeat the "LOW" state and the "HIGH" state of the charging bias. In that case, also with respect to the developing bias, the "LOW" state and the "HIGH" state may be repetitively changed to each other. Further, the timing (a) to the timing (f) are not necessarily be required to be set in the listed order. For example, the timing when the transfer bias is changed to "LOW" may also be not required to be simultaneous with the timing when the pre-exposure device is turned "OFF", and either one of the timings may be earlier. Further, the timing when the charging bias is changed to "LOW" and the timing when the developing bias is changed to "LOW" may also be such that either one of the timings is earlier or both of the timings are simultaneous with each other.

Other Embodiments

The present invention was described above based on the specific embodiment, but is not limited to the above-described embodiment.

For example, in the above-described embodiment, the case where the present invention is applied to the image forming apparatus of the DC charging type in which only the DC voltage is applied to the charging member was described as an example, but the present invention is also applicable to an image forming apparatus of an AC charging type in which as the charging voltage, an oscillating voltage in the form of a DC voltage (DC component) is biased with an AC voltage (AC component) is used. Also in this case, in the cleaning operation, it is possible to obtain an effect similar to the effect of the above-described embodiment if a potential relationship similar to that in the above-described embodiment is satisfied with respect to the DC component (DC bias) of the charging voltage.

In the above-described embodiment, with respect to the developing voltage, only the DC component was described, but the developing voltage may also be an oscillating voltage in the form of a DC voltage (DC component) is biased with an AC voltage (AC component). Also in this case, in the cleaning operation, it is possible to obtain an effect similar to the effect of the above-described embodiment if a potential relationship similar to that in the above-described embodiment is satisfied with respect to the DC component (DC bias) of the developing voltage.

In the above-described embodiment, the charging member as being rotationally driven with the peripheral speed difference from the image bearing member. As a result, as described above, a contamination such as the toner charged to the opposite polarity to the normal polarity is not readily deposited on the charging member, but the charging member may also be rotated by the rotation of the image bearing member.

In the above-described embodiment, the charging member was described as the roller-shaped member, but is not limited thereto. For example, also a rotatable member in another shape, such as an endless belt-shaped charging member wound around a plurality of supporting rollers (e.g., in which one of the plurality of supporting rollers is contacted to the belt toward the image bearing member) can be suitably used.

In the above-described embodiment, the cleaning operation of the charging roller 2 was described as being performed in the post-rotation step during the non-image formation, but is not limited thereto. The cleaning operation can be executed at any timing if the timing is in a period of the non-image formation. For example, in the above-described embodiment, in the case where the number of sheets subjected to image output is a predetermined threshold or more in a certain job, the cleaning operation of the charging member was executed in the post-rotation step after all the image formation in the job is ended. On the other hand, in the case where the number of sheets subjected to image output is the predetermined threshold or more during the job, the cleaning operation of the charging member can be executed in an extended sheet interval or the like.

In the above-described embodiment, as an index for estimating a degree of deposition (accumulation), on the charging member of the contamination such as the toner charged to the opposite polarity to the normal polarity, information on the integrated number of sheets subjected to image output was used, but the index is not limited thereto. As the index, it is possible to suitably use any information, interrelating with an amount of use (operation) of the charging member, such as the number of rotation of the charging member, a rotation time of the charging member, an application time of the charging voltage, or the like, and a threshold corresponding to each of the indices may only be required to be set.

In the above-described embodiment, in the period from the timing (c) to the timing (e), the developing bias was kept at "LOW" so that the developing bias is the voltage (e.g., the voltage having the same polarity as that of the surface potential of the photosensitive drum 1 but having a smaller absolute value than that of the surface potential of the photosensitive drum 1) higher in the positive polarity side than the surface potential of the photosensitive drum 1. However, the present invention is not limited thereto. That is, the following step may also be performed when the present invention employs such a constitution that the developing sleeve 41 is movable between a developing position (contact position) where the developing sleeve 41 contacts the photosensitive drum 1 and a spaced position where the developing sleeve 41 is spaced from the photosensitive drum 1. That is, it is also possible to perform such a step that the developing sleeve 41 is moved from the developing position to the spaced position at the timing (c) and then is moved from the spaced position to the developing position at the timing (e). By performing this step, most of the positively charged toner on the photosensitive drum 1 passes through the developing portion c where the developing sleeve 41 is in the spaced state from the photosensitive drum 1.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-203505 filed on Oct. 1, 2014, which is hereby incorporated by reference herein in its entirety.

What is claimed is:

1. A method of executing a cleaning operation in an image forming apparatus that includes (a) a rotatable image bearing member, (b) a charging member for electrically charging the image bearing member while contacting the image bearing member at a charging position by being supplied with a charging voltage, (c) an electrostatic image forming unit for forming an electrostatic image on the electrically charged image bearing member, (d) a developing device including a developing member for forming a toner image by being supplied with a developing voltage to supply a toner charged to a normal polarity to the electrostatic image on the image bearing member at a developing position, (e) a transfer member for electrostatically transferring the toner image from the image bearing member onto a toner image receiving member at a transfer portion by being supplied with a transfer voltage, (f) a discharging unit for discharging the image bearing member at a discharging position downstream of the transfer position and upstream of the charging position with respect to a rotational direction of the image bearing member, and (g) a controller for executing the cleaning operation during non-image formation, the method comprising:

a transfer step of transferring an opposite polarity toner deposited on the charging member and charged to an opposite polarity opposite to the normal polarity from the charging member onto the image bearing member at the charging position;

a discharging step of discharging, by the discharging unit at the discharging position, a region of the image bearing member where the opposite polarity toner is deposited;

a polarity inversion step of inverting the opposite polarity toner deposited on said image bearing member into a normal polarity toner charged to the normal polarity by passing the region discharged by the discharging step through the charging position in a state in which the charging voltage is applied to the charging member; and a collecting step of collecting the normal polarity toner by transferring the normal polarity toner from the image bearing member onto the developing member at the developing position.

2. The method of executing a cleaning operation according to claim 1, wherein in the polarity inversion step, electric discharge is generated between the image bearing member and the charging member.

3. The method of executing a cleaning operation according to claim 1, wherein a region of the image bearing member where the toner charged to the opposite polarity is to be transferred in the transfer step passes through the discharging position without being discharged by the discharging unit after being charged by the charging member and then reaches the charging position, and the toner charged to the opposite polarity is transferred from the charging member onto the image bearing member.

4. The method of executing a cleaning operation according to claim 3, wherein the region of the image bearing member where the toner charged to the opposite polarity is to be transferred in the transfer step passes through the transfer position after being charged by the charging member, the transfer position being in a state in which a voltage higher in a normal polarity side than a voltage applied to the transfer member during image formation is applied to the transfer member, and then reaches the charging position, and the toner charged to the opposite polarity is transferred from the charging member onto the image bearing member.

5. The method of executing a cleaning operation according to claim 4, wherein the voltage higher in the normal polarity side than the voltage applied to the transfer member during the image formation is opposite in polarity to the voltage applied to the transfer member during the image formation.

6. The method of executing a cleaning operation according to claim 1, wherein in the transfer step, a first charging voltage higher in an opposite polarity side to the normal polarity than a surface potential of the image bearing member is applied to the charging member, and in the polarity inversion step, a second charging voltage higher in a normal polarity side than the first charging voltage is applied to the charging member.

7. The method of executing a cleaning operation according to claim 1, wherein when the region where the toner charged to the opposite polarity is transferred in the transfer step passes through the developing position, the controller applies a first developing voltage higher in an opposite polarity side to the normal polarity than a surface potential in a region of the image bearing member where the toner charged to the opposite polarity is transferred.

8. The method of executing a cleaning operation according to claim 6, wherein the first charging voltage is 0 V.

9. The method of executing a cleaning operation according to claim 1, wherein only a DC voltage is applied to the charging member.

10. The method of executing a cleaning operation according to claim 1, wherein in the transfer step, a charging voltage higher in a normal polarity side than a surface potential of the image bearing member is applied to the charging member.

11. The method of executing a cleaning operation according to claim 1, wherein the discharging unit discharges the image bearing member at the discharging position by irradiation with light.

* * * * *